United States Patent [19]

Demello et al.

[11] Patent Number: 4,488,469

[45] Date of Patent: Dec. 18, 1984

[54] MUSICAL INSTRUMENT HOLDER

[76] Inventors: Xavier J. Demello; Deborah K. Pennington, both of 1145 Hague Ave., Saint Paul, Minn. 55104

[21] Appl. No.: 349,985

[22] Filed: Feb. 18, 1982

[51] Int. Cl.[3] ..... G10G 5/00

[52] U.S. Cl. ..... 84/385 A; 84/453; 248/201; 248/462

[58] Field of Search ..... 84/327, 385 B, 387 A, 84/453, 329, 421; 248/462, 463, 201, 441

[56] References Cited

U.S. PATENT DOCUMENTS

| | | | |
|---|---|---|---|
| 1,262,163 | 4/1918 | Beethoven | 84/385 B |
| 1,359,811 | 11/1920 | Kirkendall et al. | 248/462 |
| 1,570,168 | 1/1926 | Mortensen . | |
| 1,975,303 | 10/1934 | Walker et al. | 248/40 |
| 2,015,029 | 9/1935 | Bernath | 84/453 |
| 2,163,859 | 6/1939 | Bockel | 24/263 |
| 2,262,556 | 11/1941 | Richmond | 84/385 B |
| 2,484,427 | 10/1949 | Schwenk | 248/42 |
| 3,175,793 | 3/1965 | Kennedy | 248/99 |
| 3,178,032 | 4/1965 | Patrick et al. | 248/201 X |
| 3,193,325 | 7/1965 | Wenger | 297/186 |
| 3,208,597 | 9/1965 | Hansen | 211/32 |
| 3,259,428 | 7/1966 | Wenger et al. | 297/186 |
| 3,357,666 | 12/1967 | Smith et al. | 248/125 |
| 3,958,786 | 4/1976 | Mann | 248/176 |
| 4,036,462 | 7/1977 | Sheftel | 248/166 |
| 4,078,753 | 3/1978 | Cole | 248/204 |
| 4,300,743 | 11/1981 | Morris | 248/441 R |

*Primary Examiner*—Lawrence R. Franklin

*Attorney, Agent, or Firm*—Merchant, Gould, Smith, Edell, Welter & Schmidt

[57] ABSTRACT

A musical instrument holder (10) for use with a sheet music stand (20) is disclosed. The sheet music stand (20) has a ledge (22) for supporting sheet music. The holder (10) includes a first support member (11) having a first end (11*a*) and second end (11*b*) and a second support member (12) having a first end (12*a*) and second end (12*b*). A first holding device (14) is attached to the first end (11*a*) of the first support member (11) and a second holding device (15) is attached to the first end (12*a*) of the second support member (12). An elongate cross support member (13) has a first end (13*a*) connected to the second end (11*b*) of the first support member (11) and a second end (13*b*) connected to the second end (12*b*) of the second support member 12. The cross support member (13) is positioned on and supported by the ledge (22) of the sheet music stand (20). The support members (11) and (12) extend generally downward from the ledge (22). In a preferred embodiment, the second holding device (15) is a circular ring having a protective covering (16) and the first holding device (14) is a semicircular member having a protective covering (16). In another embodiment, means for releasably cooperatively connecting the second end of the support members to the ledge (22) of the sheet music stand (20) is provided. In still another embodiment, means for cooperatively connecting the support members to the sheet ledge (22), forming an integral part thereof, is provided.

3 Claims, 5 Drawing Figures

FIG. 1
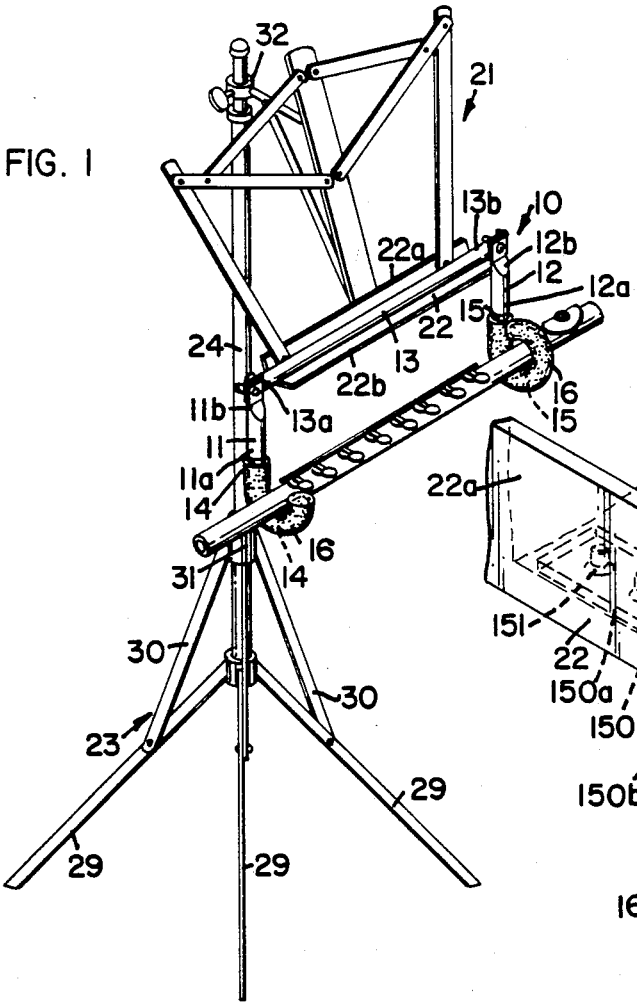
FIG. 5
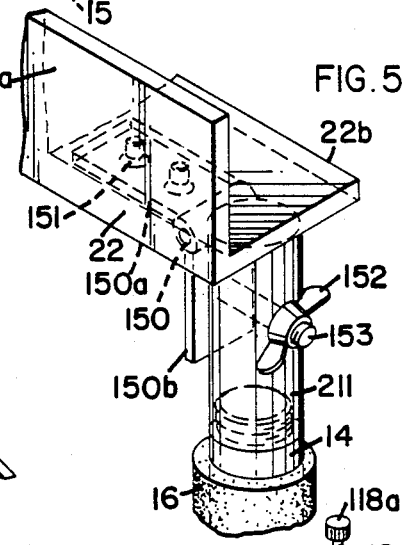
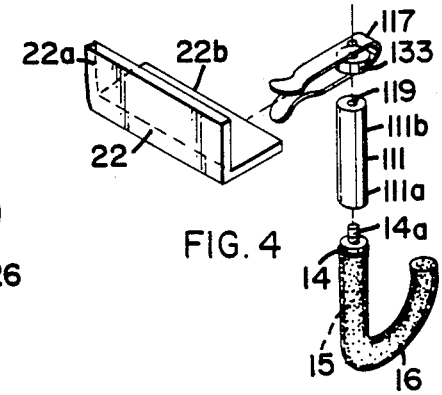
FIG. 4
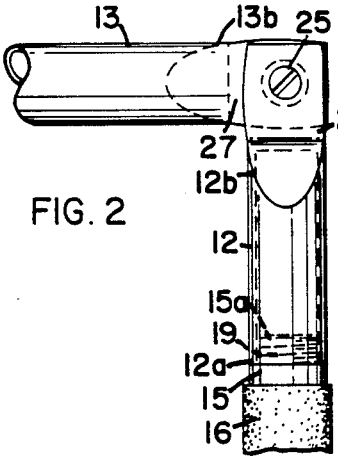
FIG. 2
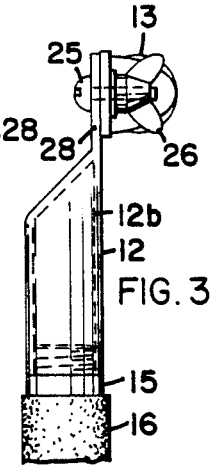
FIG. 3

MUSICAL INSTRUMENT HOLDER

BACKGROUND OF THE INVENTION

1. Field of the Invention

This invention relates generally to musical instrument holders. More particularly, this invention relates to musical instrument holders for use with a sheet music stand.

2. Description of the Prior Art

Numerous holders are disclosed by the prior art for holding a musical instrument. One class of holders are those that are used in combination with a chair. Typically, such holders are used for large instruments and assist the player in supporting a portion of the weight of the instrument. Such holders are quite bulky, cumbersome, and are not easily transportable.

A second class of musical instrument holders includes those that are an integral part of an upright stand. Again, this type of holder is usually used for larger instruments and are not capable of being moved to other stands.

A third class of holders includes those holders that are positioned on the floor. An example of such a holder would be a holder having a small tripod base with an upwardly extending cone from the base. To support the instrument, the bell end portion of the instrument is inserted over the upwardly extending cone. Such supports are quite susceptible to being kicked or bumped, thereby causing the instrument to fall over and become damaged.

A fourth class of musical instrument holders are those that are used in connection with sheet music stands. U.S. Pat. No. 1,975,303 issued Oct. 2, 1934 to H. Walker et al is an example of such a holder. A horizontal bracket has a V-shaped channel formed in the middle of the bracket. The bracket partially encircles the periphery of the upright of the music stand and lines up the bracket in a horizontal position. The bracket is removably fastened to the upright of the music stand by means of a clamping member. A thumb nut must be tightened to secure the clamping member to the upright stand. Supporting arms project downwardly and outwardly from the bracket and are bent upward as suitable angles to form a cradle in which such instruments as trumpets can be placed. Each of the supporting arms is covered with felt to keep the arms from scratching the instrument. While such an instrument holder is removable from the music stand, it is necessary to loosen the thumb nut in order to release the instrument holder.

The present invention addresses the problems associated with the prior art instrument holders.

SUMMARY OF THE INVENTION

The present invention includes a holder for musical instruments for use with a sheet music stand. The sheet music stand has a ledge for supporting sheet music. The holder includes first and second support members each having first and second ends. A first holding device is attached to the first end of the first support member and a second holding device is attached to the first end of the second support member. An elongate cross support member has a first end connected to the second end of the first support member and a second end connected to the second end of the second support member. The cross support member is positioned on and supported by the ledge of the sheet music stand. The support members extend generally downward from the ledge.

In a preferred embodiment, the second holding device is a circular ring having a protective covering and the first holding device is a semi-circular member having a protective covering.

In another embodiment, means for releasably cooperatively connecting the second end of the support members to the ledge of the sheet music stand is provided.

In still another embodiment, means for cooperatively connecting the support members to the sheet music ledge, forming an integral part thereof, is provided.

BRIEF DESCRIPTION OF THE DRAWING

FIG. 1 is a view in perspective of the musical instrument holder incorporating my present invention.

FIG. 2 is an enlarged front plan view of a portion of the musical instrument holder of FIG. 1.

FIG. 3 is a side elevation of the portion of the musical instrument holder of FIG. 2.

FIG. 4 is an exploded view in perspective of another embodiment of the musical instrument holder.

FIG. 5 is a view in perspective showing still another embodiment of the musical instrument holder incorporating my present invention.

DESCRIPTION OF THE PREFERRED EMBODIMENT

Referring to the drawing, wherein like numerals represent like parts throughout the several views, a musical instrument holder designated generally as 10 is shown in FIG. 1.

A sheet music stand, designated generally as 20, includes a support base 23, an upright stand member 24 and a sheet music support 21. The support base 23 has three legs 29 connected to the bottom end of the upright stand member 24. A connecting arm 30 is attached to each leg 29 at one end and a slidable collar 31 at its other end. The collar 31 is slidable along the upright stand member 24. As the collar moves upward, the legs 29 pivot and collapse along the side of the upright stand member 24. The sheet music support 21 is attached to the top portion of the upright stand member 24 and is adjustable by means of sliding collar 32. The sheet music support 21 has a ledge 22 having an upwardly extending flange **22*a* and a shelf support 22*b*. Sheet music is supported by simply placing the bottom of the sheets on the ledge 22 and the back of the sheet music is supported by the various arms of the sheet music support 21. Such sheet music stands are well-known in the art and the sheet music stand 20** is illustrative of one such stand.

The musical instrument holder 10, as shown in FIG. 1, includes a first support member 11 having a first end **11*a* and a second end 11*b* and a second support member 12 having a first end 12*a* and a second end 12*b*. A first holding device 14 is attached to the first end 11*a* of the first support member 11. A second holding device 15 is attached to the first end 12*a* of the second support member 12**.

One method of attaching the holding devices to the support members is shown in FIGS. 2 and 3. The support member 12 has a threaded bore 19. The holding device 15 has a threaded end **15*a*. To attach the holding device to the support member 12, the threaded end 15*a* is simply screwed into the threaded bore 19. Holding device 14 is similarly attached to support member 11**. It is understood that there are other suitable methods of attaching the holding device to the support member. The holding device and the support member may also be a single unit.

In a preferred embodiment, the support members 11 and 12 are pivotally connected to an elongate cross support member 13. As shown in FIGS. 2 and 3, the second end 13*b* of the cross support 13 has a flattened area 27. The second end 12*b* of the second support member 12 has a flattened area 28. A screw 25 and wing nut 26 are used to pivotally connect the cross member 13 and second support member 12. The first support member 11 is attached to the cross member 13 in a similar manner. It is understood that other suitable means may be used to pivotally attach the support members 11 and 12 to the cross support 13.

In a preferred embodiment, the second holding device 15 is a circular ring having a protective covering 16. The first holding device 14 is semi-circular and has a protective covering 16. The protective covering 16 may be plastic, rubber or other suitable material to protect the musical instrument from being scratched. The protective covering 16 may be in the form of a sleeve and be placed around the holding devices 14 and 15 or may be coated directly onto the holding devices.

In a preferred embodiment, the first and second support members are the same length, so that the musical instrument is supported generally parallel to the ledge 22 of the sheet music stand.

To use the musical instrument holder 10, the cross support member 13 is simply positioned on and supported by the ledge 22 of the sheet music stand 20. The support members 11 and 12 extend generally downward from the ledge 22. The musical instrument is then placed on and supported by the holding devices 14 and 15. If the holding device 15 is circular, it is necessary to first place one end of the musical instrument inside the holding device 15 and the other end of the musical instrument is then allowed to be lowered into position on the holding device 14.

Another embodiment of the present invention is shown in FIG. 4. The holding device 14 and protective covering 16 are the same as described in the previous embodiment. A first support member 111 has a threaded bore 119 extending from a first end 111*a* to a second end 111*b*. The first end 111*a* is threaded onto the first end 14*a* to attach the first holding device 14 to the first support member 111. The second end 111*b* is cooperatively connected to the ledge 22 of the sheet music stand 20. In a preferred embodiment, the first support member is releasably connected to the ledge 22 of the sheet music stand 20. A spring clip 117 is connected to the first support member 111 by means of a threaded bolt 118 having a knurled end 118*a*. A washer 133 is positioned between the forks of the clamp 117, so that when the bolt 118 is tightened through the clamp 117 and into the threaded bore 119, the forks of the clamp 117 are not broken.

To releasably attach the support member 111 and holding device 14 to the sheet music stand 20, the forks of the clamp 117 are simply pushed onto the ledge 22. The second support member 12 and holding device 15 are similarly constructed and is attached to the opposite end of the ledge 22. The two holding devices 14 and 15 are then in position to support and hold a musical instrument.

In another embodiment, as shown in FIG. 5, the musical instrument holder is an integral part of the sheet music stand 20. A first plate 150*a* of hinge 150 is secured to the shelf support 22*b* of the ledge 22 by screws 151. The second plate 150*b* of hinge 150 is secured to a first support member 211 by bolt 153 and wing nut 152. Similar to the other embodiments, the first holding device 14 is secured to the first support member 211. A second support member and holding device, being a mirror image of the first support member and first holding device, is secured to the other end of the ledge 22.

It can be seen that the musical instrument holder 10 is light, portable and easily carried. By supporting the musical instrument above the floor, kicking or bumping the musical instruments placed on the floor is eliminated. Examples of musical instruments that can be held by the musical instrument holder 10 are flutes, oboes, clarinets, violin bows and trumpets.

The other modifications of the invention will be apparent to those skilled in the art in light of the foregoing description. This description is intended to provide specific examples of individual embodiments which clearly disclose the present invention. Accordingly, the invention is not limited to these embodiments or to the use of elements having specific configurations and shapes as presented herein. All alternative modifications and variations of the present invention which follows in the spirit and broad scope of the appended claims are included.

What is claimed is:

1. A holder for a musical instrument for use with a sheet music stand, the stand having a ledge for supporting sheet music, the ledge having a top surface, said holder comprising:

(a) a first and second support members each having first and second ends;

(b) a first holding device attached to said first end of said first support member and a second holding device attached to said first end of said second support member, said holding devices being shaped to hold said musical instrument;

(c) means for supporting said second ends of said support members, said supporting means comprising a cross support member pivotally connected to said second ends of said first and second support members, said cross support member being adapted to rest on said music stand ledge; and (d) said first and second support members extending generally downward from said cross support member when in position to hold said musical instrument and folding adjacent said cross support member when in position to be transported, whereby said holder can readily be raised from said ledge without requiring the loosening of a threaded fastener and independently transported.

2. The holder of claim 1, wherein said first and second support members are the same length, wherein the musical instrument is supported generally parallel to the ledge of the sheet music stand.

3. The holder of claim 2, wherein said first holding device is a circular ring, said ring having a protective covering and said second holding device is semi-circular having a protective covering.

* * * * *